US006908418B2

(12) United States Patent
Sauré

(10) Patent No.: US 6,908,418 B2
(45) Date of Patent: Jun. 21, 2005

(54) DOOR MOUNTED DEADMAN FOR EXERCISE DEVICES

(76) Inventor: Paul Sauré, 1213 Monroe St., Santa Rosa, CA (US) 95403

( * ) Notice: Subject to any disclaimer, the term of this patent is extended or adjusted under 35 U.S.C. 154(b) by 17 days.

(21) Appl. No.: 10/366,736

(22) Filed: Feb. 14, 2003

(65) Prior Publication Data

US 2003/0158024 A1 Aug. 21, 2003

Related U.S. Application Data

(60) Provisional application No. 60/357,365, filed on Feb. 15, 2002.

(51) Int. Cl.[7] ..... A63B 21/00
(52) U.S. Cl. ..... 482/121; 482/907; 482/904
(58) Field of Search ..... 482/904, 907, 482/126, 121, 124, 129, 130

(56) References Cited

U.S. PATENT DOCUMENTS 680,556 A * 8/1901 Wieland
5,254,065 A 10/1993 Pollock
5,468,205 A 11/1995 McFall et al.
5,601,518 A 2/1997 Weintraub
6,036,625 A * 3/2000 Woodruff
6,059,698 A 5/2000 Mazor
6,322,483 B1 * 11/2001 Rotella

* cited by examiner

*Primary Examiner*—Jerome W. Donnelly
(74) *Attorney, Agent, or Firm*—William Michael Hynes; Townsend and Townsend and Crew LLP

(57) ABSTRACT

A door-mounted strap extends around a door in the vertical direction, typically being placed medially of the door. On the deadman side of the door, the strap is continuous as it faces the exerciser. On a face of the door, away from the exerciser, the strap has a tension-locking clamp, typically a ladder lock, enabling the tightened door-mounted strap to snugly surround the door. Extending from the door top to the door bottom on exerciser's side of the door is a back-mounting strip that exceeds in width and underlies the door-mounted strap. This back-mounting strip is sewn at intervals to enclose the horizontally disposed linear back members of D-rings at approximate 10-inch intervals. Removable and attachable elastic members are provided for fastening to the arcuate portions of the D-rings. These D-rings and elastic members are provided in combination with handholds, limb straps, at the like to enable standing, sitting or prone exercise positions between the D-rings at the deadman and the exerciser.

1 Claim, 4 Drawing Sheets

DOOR MOUNTED DEADMAN FOR EXERCISE DEVICES

This invention relates to a door attached deadman for an exercise devices. Specifically, a door mounted vertical strap cooperating with the door jambs and lintel is disclosed for providing any room with a door as a candidate location for wall mounted exercise devices.

This application claims priority from Provisional Patent Application 60/357,365 filed Feb. 15, 2002 entitled Door Mounted Deadman for Exercise Devices.

BACKGROUND OF THE INVENTION

Doors have in the past been used for mounting a variety of exercise devices. Exemplary of such mountings are:

Pollock U.S. Pat. No. 5,254,065 issued Oct. 19, 1993 entitled Flexible Loop Fastening Strap Supportable in Door Structure. In this disclosure, a strap having an enlarged end portion is trapped on one side of the door with a loop depending to the opposite side of the door. The loop acts as the anchored point from which a portion of an exercise device may be attached.

McFall et al. U.S. Pat. No. 5,468,205 issued Nov. 21, 1995 entitled Portable Door Mounted Exercise Apparatus. In this disclosure, two large pulley assemblies are mounted to the top and bottom of a door. The pulley assemblies have elastic members connecting the top pulley assembly to the bottom pulley assembly. The disclosed pulleys have relative large diameters and are canted out of the plane of the door so that they may swivel about an axis tilted toward the person utilizing the exercise device.

Weintraub U.S. Pat. No. 5,601,518 issued Feb. 11, 1997 entitled Portable Exercise Device. In this disclosure, top and bottom U-shaped brackets mount to a door to suspend an otherwise elaborate exercise device. Upper brackets and pulleys together with a lower lever produce a large essentially not portable exercise device.

Mazor U.S. Pat. No. 6,059,698 issued May 9, 2000 entitled Exercise Device for Removable Mounting on a Door. In this disclosure, top and bottom U-shaped brackets form anchor points for exercise devices.

I have discovered that such door-mounted devices suffer from at least two deficiencies. First, most devices mount relatively large mechanical structures to the door in the form of pulleys, levers, top and/or bottom mounted (typically U-shaped) brackets. These large mechanical structures subtract from the exercise device's portability, which is the principle reason for mounting the device to a door in the first place. Secondly, and most importantly, all these devices locally strain the door edges, usually at the top or the bottom of the door. These local strains on the door edges render device mounting damaging to the door and can produce hazardous conditions.

In the following specification, I will refer to the structure of a door. As most are aware, a door closes between two doorjambs with a lintel extending across the door top. Typically, the door is mounted by hinges at one doorjamb and swings to and from positions of engagement of a lock set to the other doorjamb. I describe a door having a closing face and an opening face. The closing face of the door closes into the doorframe consisting of the doorjambs and lintel. The opening face of the door opens out and away from the doorframe. This terminology will be used in the specification and claims that follow.

BRIEF SUMMARY OF THE INVENTION

In what follows, I solve this deficiency by first constructing a strap deadman which optimally strains a door by tension only into the door's jambs and lintels so that a vertically disposed strap on a face of the door can act as the deadman point of attachment. Secondly, I disclose a deadman having a plurality of attachment points. The resulting deadman cooperates with simple strain producing members—such as elastic tubes—which enable floor to ceiling anchor points enabling a full exercise vocabulary adaptable to any prescribed fitness regimen.

A door-mounted strap extends around a door in the vertical direction, from the top of the door to the bottom of the door to act as a deadman preferably toward an exerciser on the closing side of the door. The strap is continuous as it faces the exerciser. On the rear side of the door, away from the exerciser, the strap has a tension-locking clamp, typically a ladder lock, enabling the tightened strap to snugly surround the door. A back-mounting strip exceeds in width and underlies the door-mounted strap at least on the side of the door disposed towards the exerciser. This back-mounting strip is sewn at intervals to enclose the horizontally disposed linear back members of D-rings at approximate 10-inch intervals. The back mounted strip typically terminates at the upper lintel of the doorframe with a thickened section to prevent circumferential excursion of the door-mounted strap relative to the door. Removable attachment elastic members for fastening to the arcuate portions of the D-rings are provided in combination with handholds, limb straps, and the like to enable standing, sitting and/or prone exercise positions. All members of the exercise device are tensile members, which can collapse for complete portability.

An advantage of the disclosed deadman is that it cooperates with the doorjambs and lintels to impart all strain on a distributed basis from the door to the building structure. As a result, the door acts as a plate urged on a unitary basis into the surrounding building structure where distribution of exercise induced strain is distributed at the door periphery into the surrounding building structure.

DETAILED DESCRIPTION OF THE INVENTION

Figure 1:
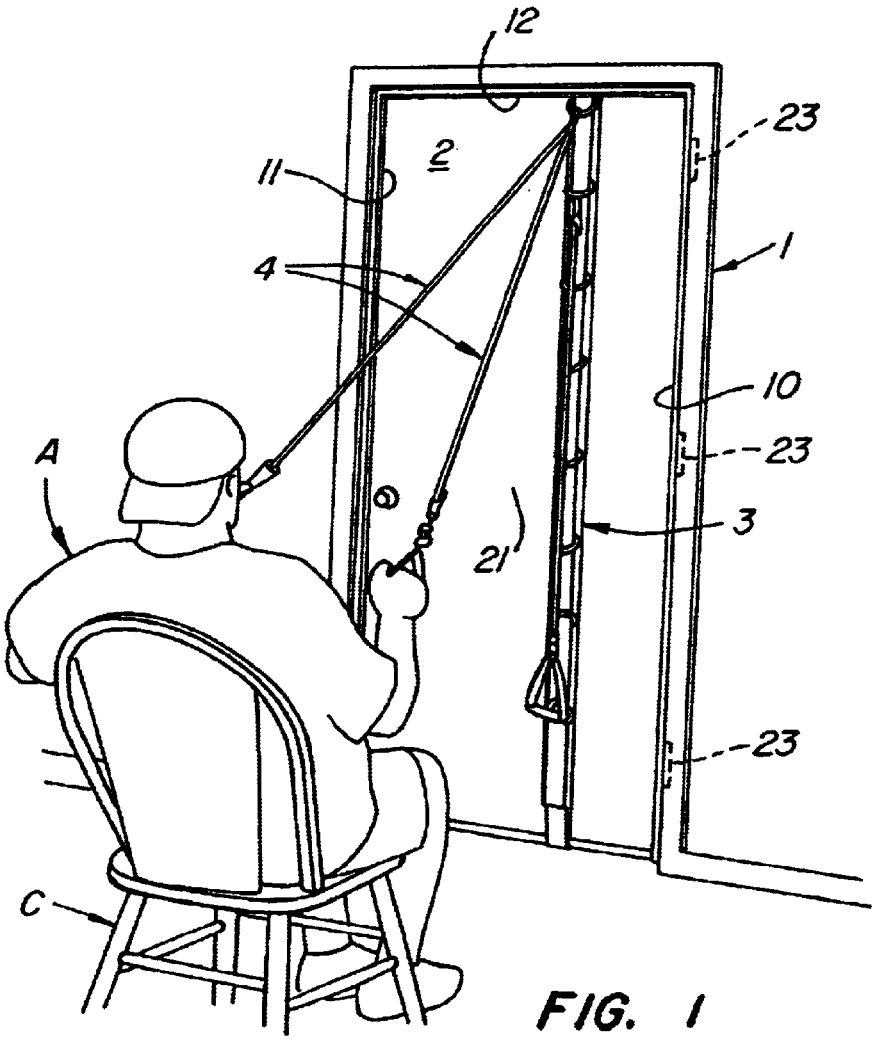
FIG. 1 is a front elevation of a door opening away from the exerciser in the sitting position with a D-ring adjacent the lintel engaged as the exercise anchor point.

Referring to FIG. 1, door 2 is surrounded by strap 3. Exerciser A utilizing elastic exercise gear 4 fastened to strap 3 at door 2 undertakes exercise as he is seated in chair C. It is the purpose of this invention to set forth a completely portable and universally mounting exercise apparatus. In what follows we will describe each of the components of this invention. First strap 3 will be described. Thereafter mounting of the strap 3 to door 2 will be set forth. Finally, the threading of exercise gear 4 to the D-rings 33 will be set forth.

Figure 3:
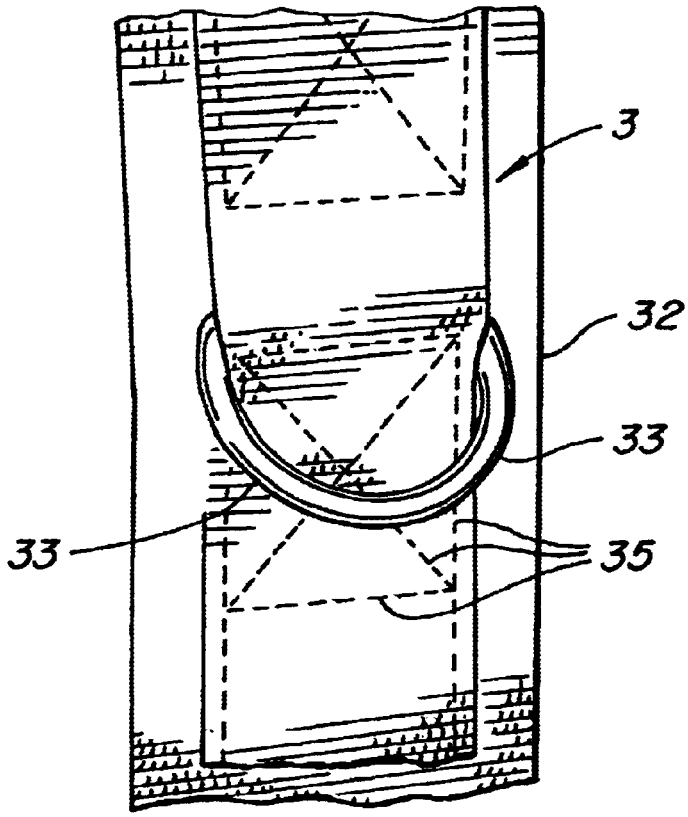
FIG. 3 is a detail adjacent a D-ring illustrating the back-mounted strip functioning to hold a D-ring in place.

The construction of strap 3 is easily understood. Referring to FIG. 3, it will be seen that strap 3 extends along closing face 21 of door 2. Along this side of door 2, strap 3 has a backing strap 32 sewn between the strap and the door 2. Sewing of strap 3 to backing strap 32 occurs at stitching 35. During this sewing attachment, D-rings are fastened between the strap 3 and backing strap 32 at approximate 10-inch intervals along one side of the strap. It will be understood that backing strap 32 has a width exceeding strap 3. This excessive width enables both the protection of door 2 and trapping of the D-rings 33 at their vertical members.

Figure 4:
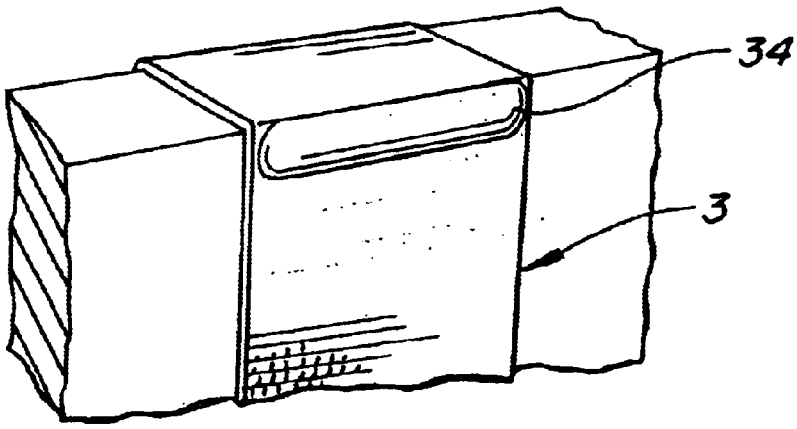
FIG. 4 is an expanded detail at the top of the door illustrating the back-mounted strip at the lintel to prevent strap circumferential excursion.

Unless unrestrained it would be possible for strap 3 to rotate as it is fastened around door 2. Forming an enlarged section in the strapping surrounding door 2 can prevent this. An example of this is shown in FIG. 4 where backing strap 32 is gathered in a large mass at its terminal end. The reader will understand that either strap 3 or backing strap 32 can be gathering in a thickened section or volume 34. Thickened section 34 is typically registered to a lintel 10 to prevent relative rotation of the strap relative to the door 2.

It will be understood that many exercises when attached to the respective D-rings will tend to cause the strap 3 and the backing strap 31 to undertake circumferential excursion relative to the door D. Thickened section 34 will resist such excursion. Specifically, when an exerciser undertakes exercise either as set forth in FIG. 1 where the exerciser facing portion of the strap will rotate downwardly with respect to the exerciser, or as set forth in FIG. 6 where the exerciser facing portion of the strap will rotate upwardly with respect to the exerciser, such rotation is resisted.

Figure 5:
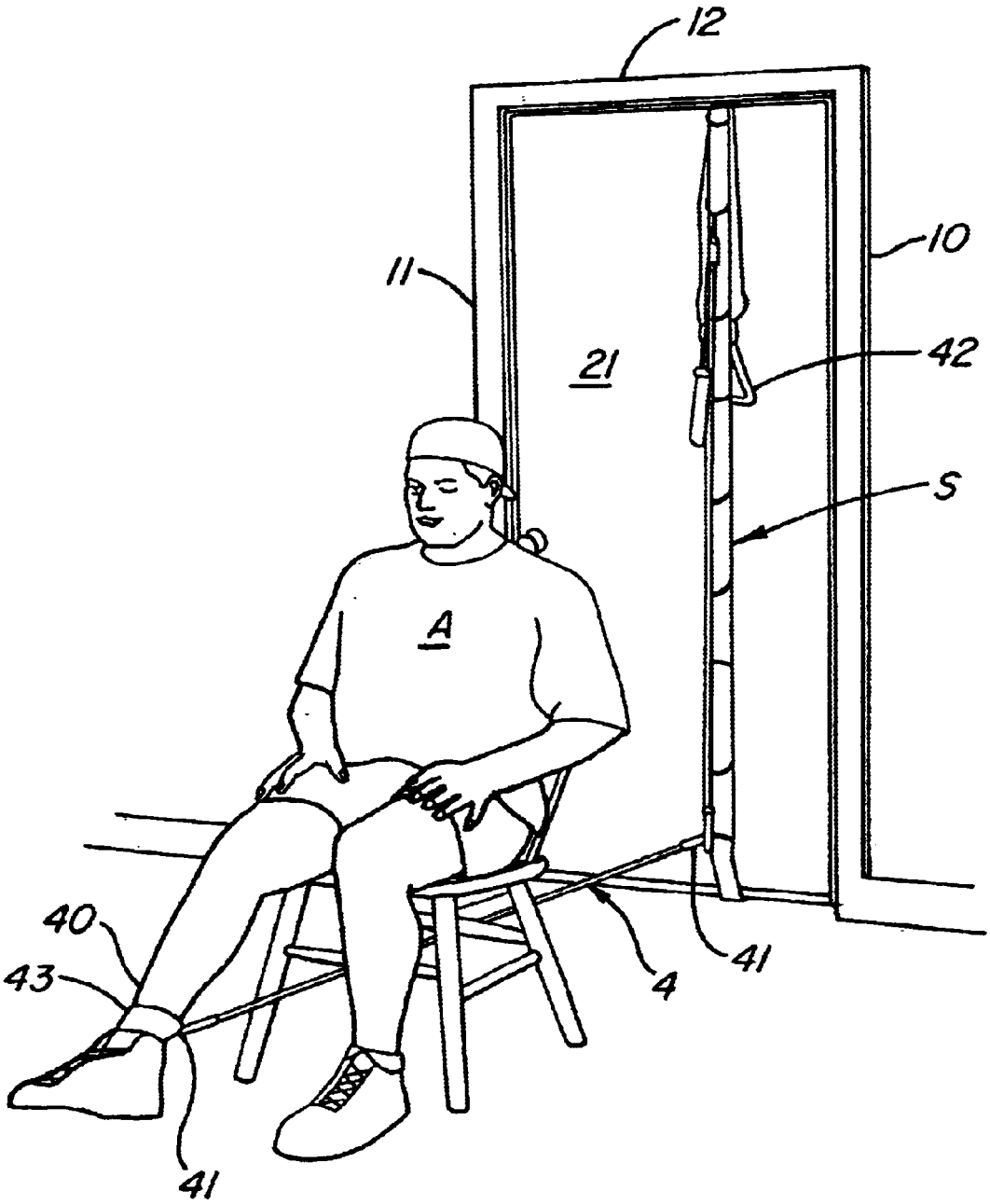
FIG. 5 illustrates a sitting exerciser doing leg exercises using the bottom of the door as the exercise anchor point.

It will be understood that strap 3 is fastened to door 2 when door 2 is in the opening position. Typically the strap 3 passes over closing face 21 of door 2, around the bottom of the door, and back over the top of the door. Backing strap 32 only extends under strap 3 at one door face. In the view of FIGS. 1 and 5, backing strap 32 extends over the closing face 21 of door 2.

Figure 2:
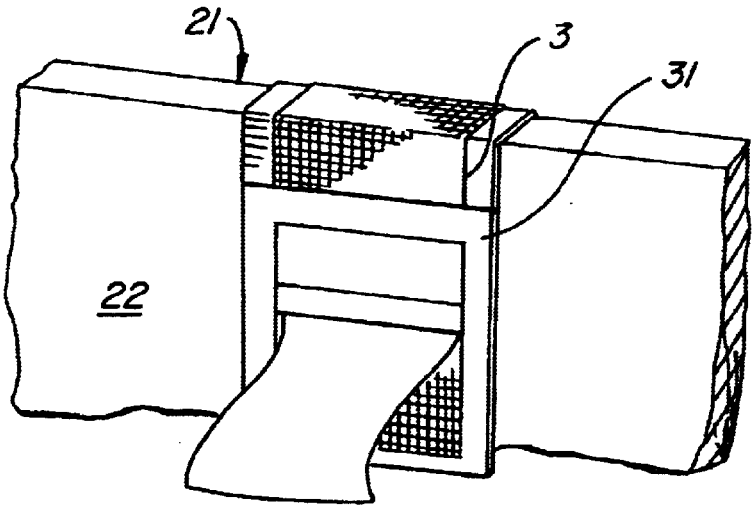
FIG. 2 is a detail of the ladder lock on the rear side of the door.

Referring to FIG. 2, strap tensioning clamp 31 (typically of the ladder lock variety) enables strap 3 to be gathered under tension snugly around the door. Once strap 3 is snugly fastened about door 2, the door is closed. In FIG. 1, the closing face 21 of door 2 swings on hinges 23 from the hinge doorjamb 10 into a locked relation with lock set doorjamb 11. Door 2 fits snugly into door frame 1 trapping strap 3 at a lintel 12. Typically thickened section 34 registers to lintel 12 to prevent relative rotation of strap 3 over door 2.

Observing FIG. 1 further, it will be seen that tension on strap 3 pulls door 2 into door frame 1 at hinge doorjamb 10 and lock set doorjamb 11. With this tension on the door, warping of the door under the strain strap 3 cannot occur. The reader will understand that it is possible to mount the strap in the opposite disposition. In this case the entire strain exerted on the strap will be transferred to a hinge 23 and lock set 24.

Once strap 3 is in place, elastic exercise gear 4 is passed through D-rings 33. Elastic exercise gear 4 is typically comprised of elastic tubing. It will be understood that other elastic tensile members can just as easily be used. For example bungee cords, tensioning coil springs, and the like can as well be used. Further it will be understood that more than one elastic exercise gear 4 can be passed through one or more of the individual D-rings. In this way tension may be varied depending upon the particular exercise undertaken as well as the particular individual involved.

Each of the elastic exercise gear 4 has clips 41 attached to either of the ends. These respective clips 41 can be attached to handholds 42 or to limb bands 43.

For example, referring to FIG. 5, it will be seen that exerciser A sits in chair C with his back to door 2. Elastic exercise gear 4 has two clips 41 (typically of the C-clip variety) at either end. The elastic exercise gear 4 has been threaded through a D-ring 33 with the clips 41 being threaded to limb band 43. In the particular case here illustrated, clips 41 fastens to strap 3 at the bottom of door 2. A limb band 43 fastens about ankle 40 of exerciser A. Exerciser A is seated in chair C, extending his leg at the ankle, exerciser A is able to undertake exercise flexing his ankle towards and away from door 2.

Figure 6:
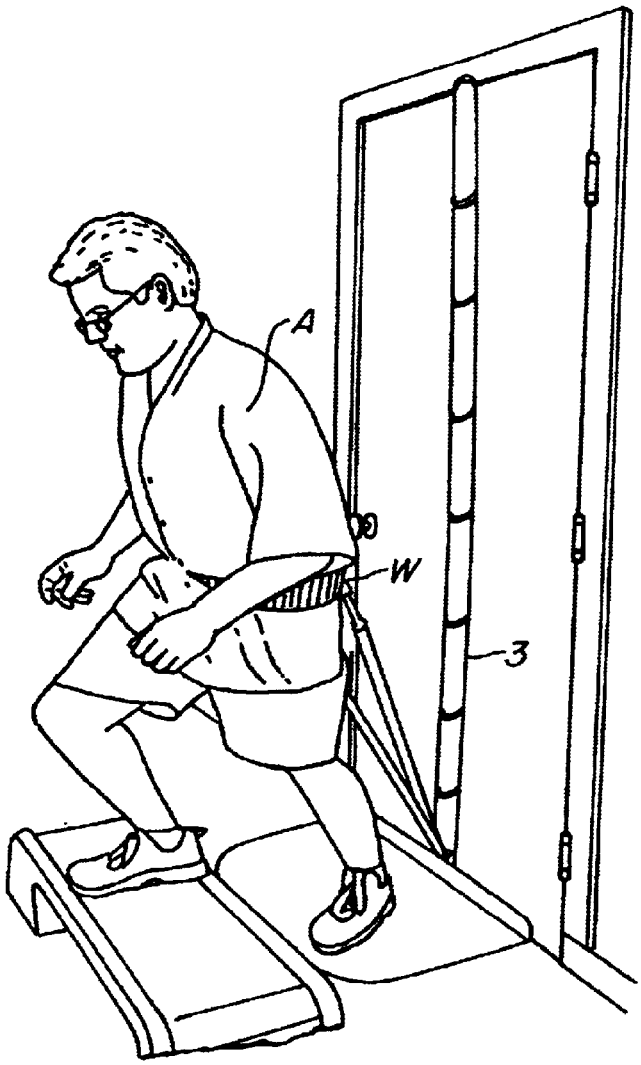
FIG. 6 is a perspective, side elevation view of an exerciser doing a step up exercise tending to impart peripheral rotation to the strap as mounted about the door; and, FIG. 7 is a perspective view of the kit like exercise device illustrating respectively the door attaching strap, a waste attaching strap, a limb attaching strap, paired arm and/or leg holds, paired handholds, and elongate handhold, a waistband, arrayed elastic exercise gear, and a carrying case.

Referring to FIG. 6, exerciser A view shown with a waistband W fastened around his waist. The elastic exercise gear 4 extends to the lowest D-ring adjacent to the base of door 2. Relative rotation of strap 3 relative to door 2 is inhibited by either a thickened section 34 or alternatively a D-ring registering to the top or bottom of door 2.

Figure 7:
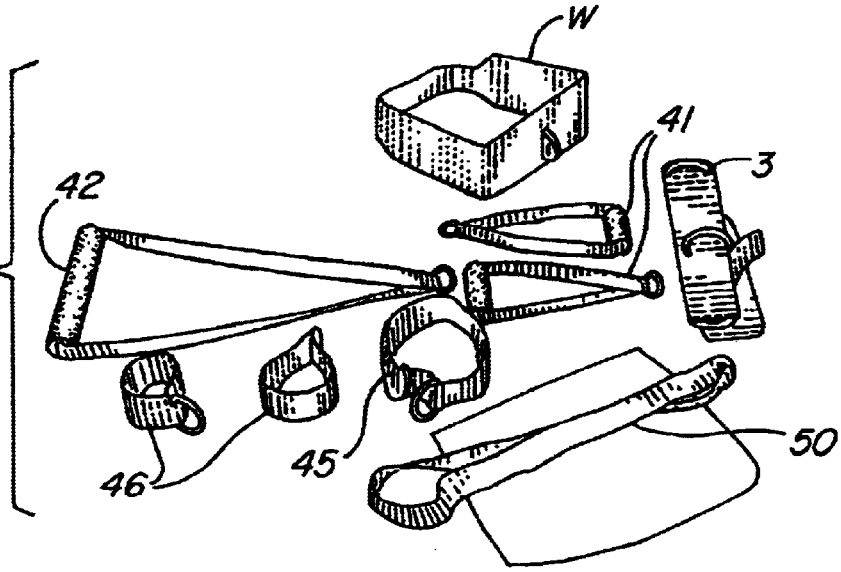

It will be understood that this invention can easily be utilized as a portable kit. The components of such a portable kit are all illustrated in FIG. 7. These components include the door mounting strap 3, waistband W, individual hand holds 41, enlarged hand hold 42, limb band 45, arm bands 46, elastic arrays 4, and finally a carrying case 50. It will be understood by the expedient of taking carrying case 50 loaded with the displayed contents of FIG. 7, a portable door attached exercise systems disclosed.

What is claimed is:

1. In combination, a deadman with a door having a top closing across a lintel, a bottom, and two sides closing across door jambs in a building structure, the door having opening and closing faces on opposite sides thereof, a mounted exercise device comprising in combination:

a door-mounted strap extending continuously around a door in the vertical direction from the top of the door to the bottom of the door across the opening and closing faces of the door;

a tension-locking clamp on one side of the door for maintaining the strap in a snug surround over the door;

a back-mounted strip between a door face and the door-mounted strap for distributing loading on the strap to the door, the back mounted strap having a width exceeding the door mounted strap;

a series of D-rings fastened between the door mounted strap and back-mounted strip for forming exercise device support points to enable the door under urging of the door-mounted strap to act as a plate urged on a unitary basis into the lintel and doorjambs whereby distribution of exercise induced strain is distributed by the back mounted strap at the width exceeding the door mounted strap at the door periphery into the surrounding building structure;

elastic strays having means for attachment and either end;

the elastic straps fastened to the D-rings at one end;

an exercise appliance for attachment with the body of an exerciser; and, the elastic straps to the exercise appliance at the other end to enable strain on the D-ring to be distributed to the back mounted strap at the width exceeding the door mounted strap to the door periphery.

* * * * *